United States Patent [19]

Wofford

[11] Patent Number: 4,744,477

[45] Date of Patent: May 17, 1988

[54] COMBINED BOTTLE CAP AND STRAW STRUCTURE

[76] Inventor: Barry Wofford, 1102 Parkside, Toledo, Ohio 43607

[21] Appl. No.: 97,048

[22] Filed: Sep. 16, 1987

[51] Int. Cl.[4] ..... B65D 51/24

[52] U.S. Cl. ..... 215/229; 215/1 A

[58] Field of Search ..... 215/229, 1 A; 220/90.2; 229/103.1

[56] References Cited

U.S. PATENT DOCUMENTS 2,837,234 6/1958 Mainiere ..... 215/229 X 3,025,004 3/1962 Levi ..... 220/90.2 X

FOREIGN PATENT DOCUMENTS 2532678 2/1976 Fed. Rep. of Germany ..... 215/229

*Primary Examiner*—Donald F. Norton

*Attorney, Agent, or Firm*—MacMillan, Sobanski & Todd

[57] ABSTRACT

A combined bottle cap and straw structure for a liquid containing bottle is disclosed. The cap includes a liner secured thereto which extends across a central region of the cap. In a first embodiment, a hollow cylindrical straw is formed integrally with the liner. A frangible region is formed at the junction between the liner and the straw. A relatively small aperture is formed through the frangible region to vent the interior of the straw to the interior of the bottle. When the cap is removed from the bottle, the straw remains attached to the cap for easy grasping. The straw can flexed relative to the cap to separate it from the liner along the frangible region. In a second embodiment, the liner is provided with an integral protrusion which extends into the open end of the bottle. The straw is formed separately from the liner, but is sized to be frictionally retained on the protrusion. The protrusion includes a relatively small groove to vent the interior of the straw portion to the interior of the bottle.

7 Claims, 1 Drawing Sheet

COMBINED BOTTLE CAP AND STRAW STRUCTURE

BACKGROUND OF THE INVENTION

The present invention relates in general to container closures and in particular to a combined bottle cap and straw structure for a liquid containing bottle.

For many years, metallic caps have been utilized as closures for bottles containing various types of liquids. Such bottle caps are generally either crimped over an enlarged diameter flange formed about an open end of the bottle or are threaded onto a threaded open end of the bottle. In either event, the bottle cap is typically provided with a liner formed from a plastic or other flexible material. When the bottle cap is secured to the bottle, the liner is engaged between the bottle cap and the bottle so as to provide a relatively air tight seal.

Straws are well known devices which are particularly well adapted to permit a person to draw liquid out of a bottle or other container directly into his or her mouth. Straws are generally hollow and cylindrical in shape and are frequently formed from a plastic or other flexible material.

SUMMARY OF THE INVENTION

The present invention relates to a combined bottle cap and straw structure for a liquid containing bottle. The cap portion of the structure is formed from a metallic material which may be threaded on or otherwise secured to an open end of the bottle. The cap portion includes a liner secured thereto which is formed from a plastic or other flexible material. The liner extends across a central region of the cap portion in order to provide a relatively air tight seal between the cap portion and the bottle. In a first embodiment of the invention, a hollow cylindrical straw portion of the structure is formed integrally with the liner. The straw portion extends through the open end into the bottle when the cap portion is secured thereto. A frangible region is formed at the junction between the liner and the straw portion. A relatively small aperture is formed through the frangible portion to vent the interior of the straw portion to the interior of the bottle. When the cap portion is removed from the bottle, the straw portion remains attached to the cap portion for easy grasping. The straw portion can then be flexed relative to the cap portion to separate it from the liner along the frangible portion. The straw is thus conveniently ready for use. In a second embodiment of the invention, the liner is provided with an integral protrusion which extends into the open end of the bottle. The straw portion is formed separately from the liner, but is sized to be frictionally retained on the protrusion. The protrusion includes a relatively small groove to vent the interior of the straw portion to the interior of the bottle.

It is an object of the present invention to provide a combined bottle cap and straw structure for a liquid containing bottle.

Other objects and advantages of the present invention will become apparent to those skilled in the art from the following detailed description of the preferred embodiments, when read in light of the accompanying drawings.

DETAILED DESCRIPTION OF THE PREFERRED EMBODIMENTS

Figure 1:
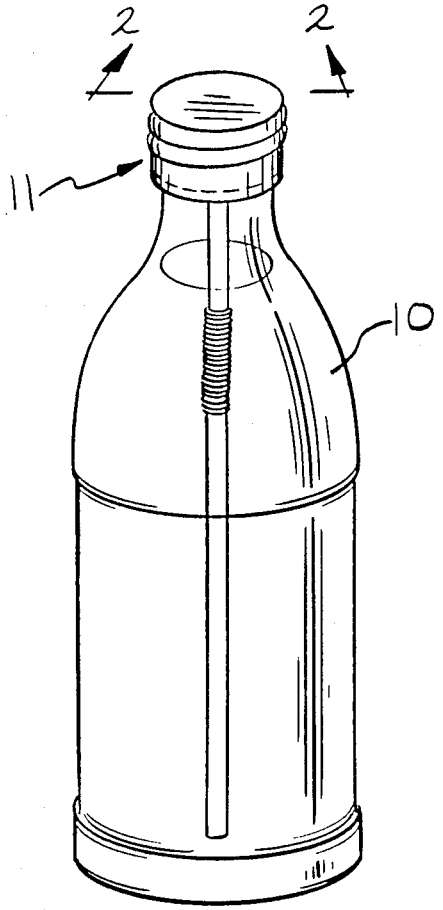
FIG. 1 is a perspective view of a bottle including a first embodiment of a combined bottle cap and straw structure in accordance with the present invention.
Figure 2:
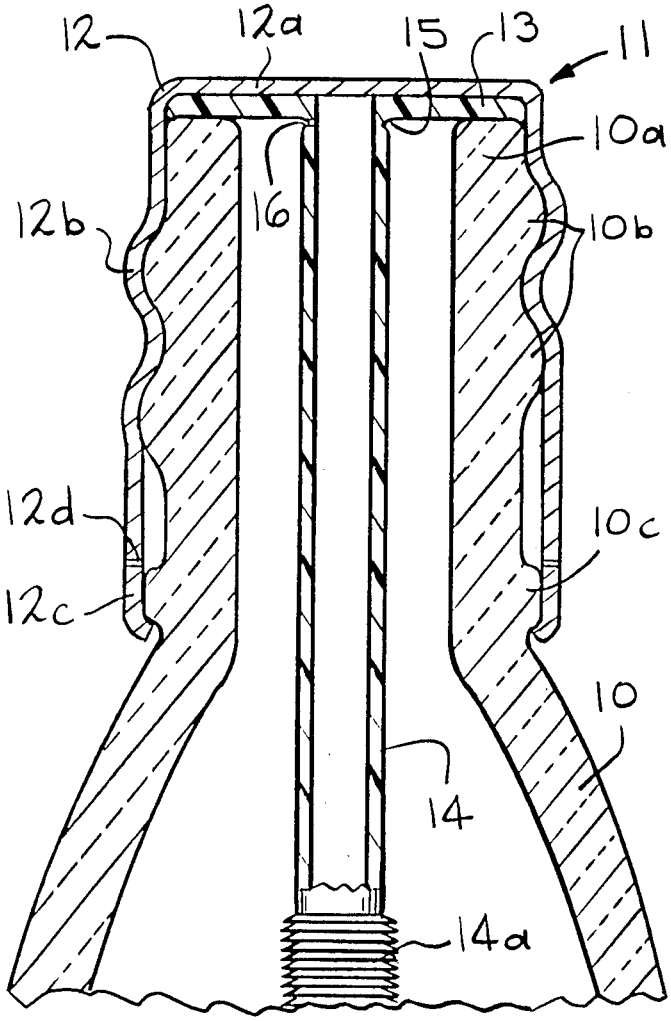
FIG. 2 is an enlarged fragmentary sectional elevational view of the bottle and the combined bottle cap and straw structure illustrated in FIG. 1.

Referring now to the drawings, there is illustrated in FIGS. 1 and 2 a bottle 10 including a first embodiment of a combined bottle cap and straw structure, indicated generally at 11, secured thereto. The bottle 10 can be any commonly known hollow container for holding liquids therein. In the illustrated embodiment, the bottle 10 includes an elongated open end 10*a* which is threaded, as shown at 10*b*, about its outer surface. The bottle 10 may further include an annular flange 10*c* formed about the lower portion of the open end 10*a*. The threaded portion 10*b* and the annular flange 10*c* are provided to retain the combined bottle cap and straw structure 11 on the bottle 10.

The combined bottle cap and straw structure 11 includes a metallic cap portion 12 having a generally flat circular central region 12*a* and a depending hollow cylindrical skirt region 12*b*. The skirt region 12*b* is formed in a known manner to cooperate with the threaded portion 10*b* of the bottle 10. A lower frangible portion 12*c* of the skirt region 12*b* extends about the annular flange 10*c* of the bottle 10. The lower frangible portion 12*c* is defined by a plurality of circumferentially spaced apertures 12*d* formed about the skirt region 12*b*. The lower end of the frangible portion 12*c* is rolled inwardly toward the bottle 10, as shown at 12*c*. As is well known, the metallic cap portion 12 is adapted to be grasped and rotated relative to the bottle 10 to remove it therefrom. Such rotation causes the frangible portion 12*c* of the cap portion 12 to break away as the cap portion 12 is moved longitudinally upwardly relative to the bottle 10 by virtue of the cooperation of the threaded portion 10*b* of the bottle 10 with the skirt region 12*b* of the cap portion 12.

A liner or seal 13 is attached by conventional means to the lower side of the central region 12*a* of the cap portion 12. The liner 13 may be formed plastic or other flexible material. When the cap portion 12 is secured to the bottle 10 as shown in FIGS. 1 and 2, the liner 13 is tightly engaged between the open end 10*a* of the bottle 10 and the radially outermost edge of the lower surface of the central region 12*a*. Consequently, a relatively air-tight seal is provided therebetween. In the embodiment illustrated in FIGS. 1 and 2, a straw portion 14 is formed integrally with the liner 13. The straw portion 14 extends through the open end 10*a* into the bottle 10 when the cap portion 12 is secured thereto. The straw portion 14 includes a conventional bellows-shaped portion 14*a* to permit the effective length thereof to be increased.

The straw portion 14 is connected to the liner 13 by means of a frangible region 15. The frangible region 15 may be formed as an annular area of the plastic material having a reduced wall thickness disposed between the straw portion 14 and the liner 13. However, other structures may be utilized which permit the straw portion 14 to be separated from liner 13, as described below. A vent hole 16 is formed through the frangible portion 15 to vent the interior of the straw portion 14 to the interior of the bottle 10.

Initially, the bottle 10 is filled with a liquid through its open end 10*a*. To close and seal the open end 10*a*, the combined bottle cap and straw structure 11 of the present invention is oriented such that the straw portion 14 is inserted through the open end 10*a* of the bottle 10 and into the liquid contained therein. As the straw portion 14 is so inserted, liquid is permitted to flow upwardly into the straw portion 14 because of the venting action provided by the vent hole 16. Without such vent hole 16, the air within the hollow straw portion 14 would be trapped therein when the straw portion 14 is inserted into the liquid. Because the vent hole 16 permits liquid to flow into the straw portion 14, only a very small amount of the available space within the bottle 10 for the liquid is occupied by the straw portion 14.

Figure 4:
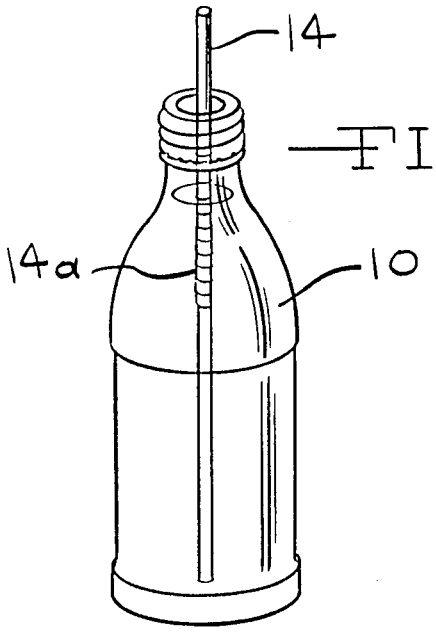
FIG. 4 is a perspective view of a bottle having the straw portion of the combined bottle cap and straw structure disposed therein for use.

As mentioned above, the cap portion 12 is secured to the open end 10*a* of the bottle 10 in any conventional fashion. When the cap portion 12 is removed, the straw portion 14 remains attached thereto and, consequently, is withdrawn from the bottle 10. The vent hole 16 permits any of the liquid within the straw portion 14 to drain back into the bottle 10 as the straw portion 14 is removed. Once the cap portion 12 is removed, the straw portion 14 can easily be detached therefrom by grasping the cap and straw portions 12 and 14 in separate hands and moving them relative to one another in a manner similar to snapping a stick. After the straw portion 14 has been detached, the bellows-shaped portion 14*a* can be expanded to increase the overall length of the straw portion 14. Lastly, the straw portion 14 can be manually re-inserted within the bottle 10, as illustrated in FIG. 4, and utilized to withdraw the liquid therefrom.

Figure 3:
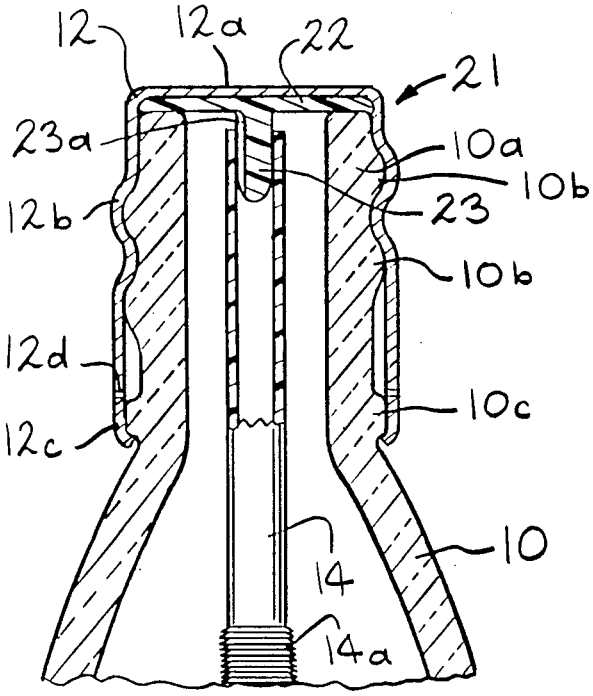
FIG. 3 is a fragmentary sectional elevational view, similar to FIG. 1, of a second embodiment of the combined bottle cap and straw structure of the present invention.

Referring now to FIG. 3, a second embodiment of the present invention is illustrated. Like reference numerals are utilized in FIG. 3 to denote those portions of the second embodiment which are similar to the corresponding portions of the first embodiment described above. A modified combined bottle cap and straw structure 21 includes a cap portion 12. A modified liner 22 is attached to the central region 12*a* of the cap portion 12. The liner 22 includes an integral protrusion 23 which extends into the open end 10*a* of the bottle 10. The protrusion 23 has a longitudinal vent groove 23*a* formed therein. The protrusion 23 is sized such that the straw portion 14 fits snugly thereover, as shown in FIG. 3, and is frictionally retained thereon. The combined bottle cap and straw structure 21 may be secured to and removed from the bottle 10 in the manner described above. The vent groove 23*a* performs the same function as the vent hole 16 described above. To separate the straw portion 14 from the cap portion 12, the straw portion 14 is grasped and pulled away longitudinally from the cap portion 12. The amount of force required to overcome the frictional engagement of the straw portion 14 on the protrusion 23 is much less than that required to separate the liner 22 from the cap portion 12.

In accordance with the provisions of the patent statutes, the principle and mode of operation of the present invention have been explained and illustrated in its preferred embodiment. However, it must be understood that the present invention may be practiced otherwise than as specifically explained and illustrated without departing from its spirit or scope.

What is claimed is:

1. A combined bottle cap and straw structure adapted to be secured to an open end of a bottle comprising:

a cap portion including a central region adapted to close the open end of the bottle and a skirt portion adapted to be secured to the bottle; and a liner attached to said central region of said cap portion, said liner including a straw portion removably secured thereto and adapted to extend into the bottle when said cap portion is secured thereto, said straw portion being formed integrally with said liner, a frangible region being provided at a junction of said straw portion with said liner.

2. The invention defined in claim 1 wherein said frangible region is formed from a reduced wall thickness portion of said straw portion.

3. The invention defined in claim 2 wherein a hole is formed through said frangible region to vent the interior of said straw portion to the interior of the bottle.

4. The invention defined in claim 3 wherein said straw portion is formed having an expandable bellows-shaped portion.

5. A combined bottle cap and straw structure adapted to be secured to an open end of a bottle comprising:

a cap portion including a central region adpated to close the open end of the bottle and a skirt portion adapted to be secured to the bottle; and a liner attached to said central region of said cap portion including an integral protrusion, said liner including a straw portion frictionally retained on said protrusion and adapted to extend into the bottle when said cap portion is secured thereto.

6. The invention defined in claim 5 wherein said protrusion is provided with a longitudinally extending groove to vent the interior of said straw portion to the interior of the bottle.

7. The invention defined in claim 6 wherein said straw portion is formed having an expandable bellows-shaped portion.

* * * * *